US007475743B2

(12) United States Patent
Liang et al.

(10) Patent No.: US 7,475,743 B2
(45) Date of Patent: Jan. 13, 2009

(54) HIGH-STRENGTH, HIGH-TOUGHNESS MATRIX BIT BODIES

(75) Inventors: Dah-Ben Liang, Woodlands, TX (US); Anthony Griffo, The Woodlands, TX (US); Thomas W. Oldham, The Woodlands, TX (US); Gregory T. Lockwood, Pearland, TX (US)

(73) Assignee: Smith International, Inc., Houston, TX (US)

( * ) Notice: Subject to any disclaimer, the term of this patent is extended or adjusted under 35 U.S.C. 154(b) by 335 days.

(21) Appl. No.: 11/343,225

(22) Filed: Jan. 30, 2006

(65) Prior Publication Data

US 2007/0175669 A1 Aug. 2, 2007

(51) Int. Cl.
*E21B 10/00* (2006.01)

(52) U.S. Cl. ..... 175/374; 175/425

(58) Field of Classification Search ..... 175/374, 175/425

See application file for complete search history.

(56) References Cited

U.S. PATENT DOCUMENTS 5,589,268 A 12/1996 Kelley et al.
5,733,649 A 3/1998 Kelley et al.
5,733,664 A 3/1998 Kelley et al.
5,967,245 A * 10/1999 Garcia et al. ..... 175/374
6,287,360 B1 9/2001 Kembaiyan et al.
6,682,580 B2 1/2004 Findeisen et al.
2004/0245024 A1 12/2004 Kembaiyan
2005/0000317 A1 1/2005 Liang et al.
2005/0211475 A1 9/2005 Mirchandani et al.
2005/0247491 A1 11/2005 Mirchandani et al.

FOREIGN PATENT DOCUMENTS

GB 2393449 3/2004
GB 2419617 5/2006
WO WO2005/106183 11/2005

OTHER PUBLICATIONS

Combined Search and Examination Report issued in GB Application No. 0701738.7 dated May 16, 2007 (8 pages).

* cited by examiner

*Primary Examiner*—Giovanna C Wright
(74) *Attorney, Agent, or Firm*—Osha • Liang LLP

(57) ABSTRACT

A drill bit that includes a bit body formed from a matrix powder and at least one cutting element for engaging a formation, wherein the matrix powder included (a) stoichiometric tungsten carbide particles, (b) cemented tungsten carbide particles, and (c) cast tungsten carbide particles, and wherein after formation with the matrix powder, the bit has an erosion rate of less than 0.001 in/hr, a toughness of greater than 20 ksi(in$^{0.5}$), and a transverse rupture strength of greater than 140 ksi is disclosed.

17 Claims, 4 Drawing Sheets

HIGH-STRENGTH, HIGH-TOUGHNESS MATRIX BIT BODIES

BACKGROUND OF INVENTION

1. Field of the Invention

This invention relates generally to a composition for the matrix body of rock bits and other cutting or drilling tools.

2. Background Art

Polycrystalline diamond compact ("PDC") cutters are known in the art for use in earth-boring drill bits. Typically, bits using PDC cutters include an integral bit body which may be made of steel or fabricated from a hard matrix material such as tungsten carbide (WC). A plurality of PDC cutters is mounted along the exterior face of the bit body in extensions of the bit body called "blades." Each PDC cutter has a portion which typically is brazed in a recess or pocket formed in the blade on the exterior face of the bit body.

The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

While steel body bits may have toughness and ductility properties which make them resistant to cracking and failure due to impact forces generated during drilling, steel is more susceptible to erosive wear caused by high-velocity drilling fluids and formation fluids which carry abrasive particles, such as sand, rock cuttings, and the like. Generally, steel body PDC bits are coated with a more erosion-resistant material, such as tungsten carbide, to improve their erosion resistance. However, tungsten carbide and other erosion-resistant materials are relatively brittle. During use, a thin coating of the erosion-resistant material may crack, peel off or wear, exposing the softer steel body which is then rapidly eroded. This can lead to loss of PDC cutters as the area around the cutter is eroded away, causing the bit to fail.

Tungsten carbide or other hard metal matrix body bits have the advantage of higher wear and erosion resistance as compared to steel bit bodies. The matrix bit generally is formed by packing a graphite mold with tungsten carbide powder and then infiltrating the powder with a molten copper-based alloy binder. For example, macrocrystalline tungsten carbide and cast tungsten carbide have been used to fabricate bit bodies. Macrocrystalline tungsten carbide is essentially stoichiometric WC which is, for the most part, in the form of single crystals. Some large crystals of macro-crystalline WC are bi-crystals. Carburized tungsten carbide has a multi-crystalline structure, i.e., they are composed of WC agglomerates.

Cast tungsten carbide, on the other hand, is formed by melting tungsten metal (W) and tungsten monocarbide (WC) together such that a eutectic composition of WC and $W_2C$, or a continuous range of compositions therebetween, is formed. Cast tungsten carbide typically is frozen from the molten state and comminuted to a desired particle size.

A third type of tungsten carbide, which has been typically used in hardfacing, is cemented tungsten carbide, also known as sintered tungsten carbide. Sintered tungsten carbide comprises small particles of tungsten carbide (e.g., 1 to 15 microns) bonded together with cobalt. Sintered tungsten carbide is made by mixing organic wax, tungsten carbide and cobalt powders, pressing the mixed powders to form a green compact, and "sintering" the composite at temperatures near the melting point of cobalt. The resulting dense sintered carbide can then be crushed and comminuted to form particles of sintered tungsten carbide for use in hardfacing.

Bit bodies formed from either cast or macrocrystalline tungsten carbide or other hard metal matrix materials, while more erosion resistant than steel, lack toughness and strength, thus making them brittle and prone to cracking when subjected to impact and fatigue forces encountered during drilling. This can result in one or more blades breaking off the bit causing a catastrophic premature bit failure. Additionally, the braze joints between the matrix material and the PDC cutters may crack due to these same forces.

The formation and propagation of cracks in the matrix body and/or at the braze joints may result in the loss of one or more PDC cutters. A lost cutter may abrade against the bit, causing further accelerated bit damage. However, bits formed with sintered tungsten carbide may have sufficient toughness and strength for a particular application, but may lack other mechanical properties, such as erosion resistance.

Accordingly, there exists a need for a new matrix body composition for drill bits which has high strength and toughness, resulting in improved ability to retain blades and cutters, while maintaining other desired properties such as wear and erosion resistance.

SUMMARY OF INVENTION

In one aspect, the present invention relates to a drill bit that includes a bit body formed from a matrix powder and at least one cutting element for engaging a formation, wherein the matrix powder included (a) stoichiometric tungsten carbide particles, (b) cemented tungsten carbide particles, and (c) cast tungsten carbide particles, and wherein after formation with the matrix powder, the bit has an erosion rate of less than 0.001 in/hr, a toughness of greater than 20 ksi($in^{0.5}$), and a transverse rupture strength of greater than 140 ksi.

In another aspect, the present invention relates to a matrix body that includes a hard particle phase and a metallic binder, wherein the hard particle phase includes (a) stoichiometric tungsten carbide particles having a mesh size between 325 mesh and 625 mesh, (b) cemented tungsten carbide particles having a mesh size between 170 mesh and 625 mesh; and (c) cast tungsten carbide particles having a mesh size between 60 mesh and 325 mesh.

In yet another aspect, the present invention relates to a method for forming a matrix body. The method may include the steps of providing a matrix powder, wherein the matrix powder includes (a) stoichiometric tungsten carbide particles having a mesh size between 325 mesh and 625 mesh, (b) cemented tungsten carbide particles having a mesh size between 170 mesh and 625 mesh, and (c) cast tungsten carbide particles having a mesh size between 60 mesh and 325 mesh, and infiltrating the matrix powder by an infiltration binder including one or metals or alloys thereof.

Other aspects and advantages of the invention will be apparent from the following description and the appended claims.

DETAILED DESCRIPTION

Figure 1:
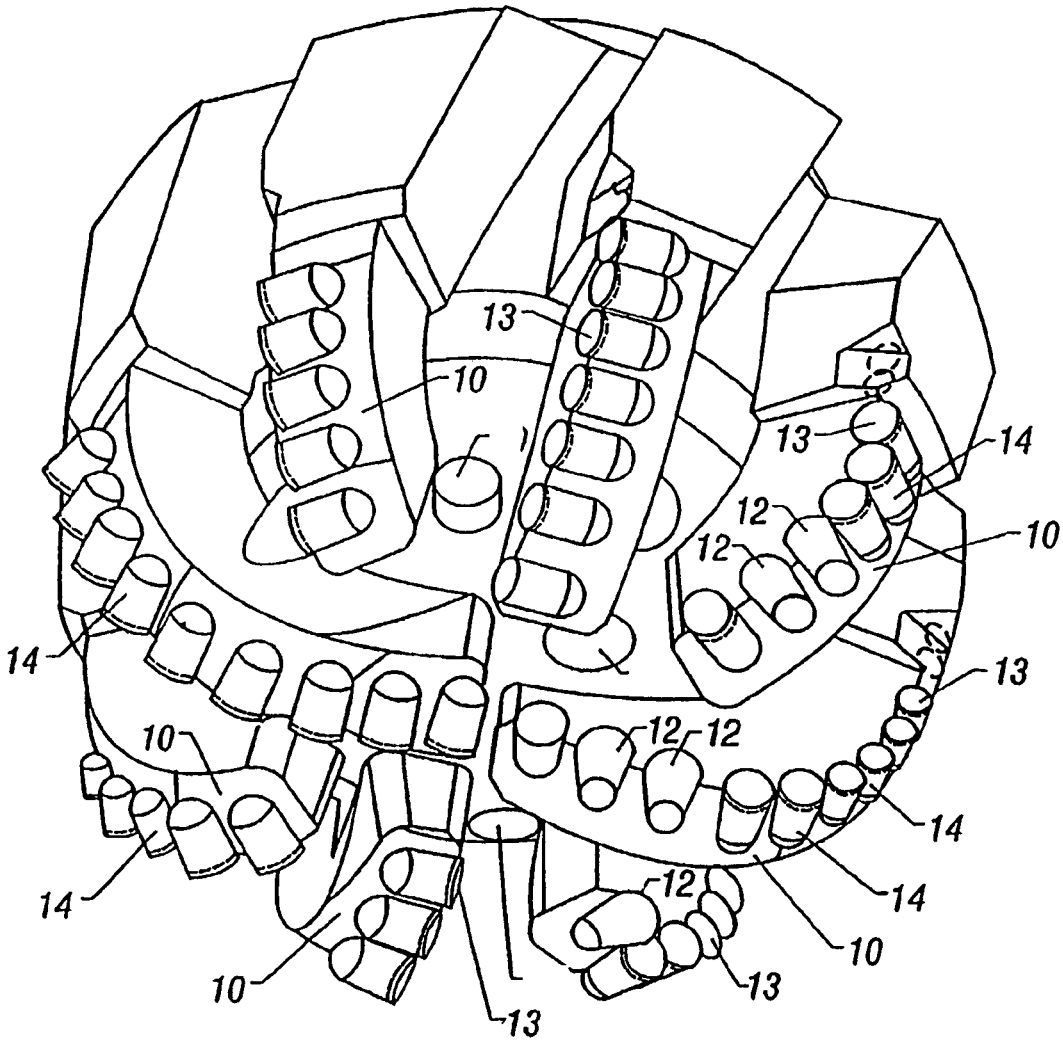
FIG. 1 is a perspective view of an earth boring PDC drill bit body with some cutters in place according to an embodiment of the present invention.

Embodiments of the invention provide mixtures of tungsten carbides suitable for forming bit bodies. In addition, embodiments of the invention provide matrix bodies which are formed from such tungsten carbides infiltrated by suitable metals or alloys as infiltration binders. Such a matrix body has high transverse rupture strength and toughness while maintaining desired braze strength and erosion resistance.

The invention is based, in part, on the determination that the life of a matrix bit body is related to the body's strength (also known as transverse rupture strength), toughness, and resistance to erosion. For example, cracks often occur where the cutters (typically polycrystalline diamond compact—"PDC" cutters) are secured to the matrix body, or at the base of the blades. The ability of a matrix bit body to retain the blades is measured in part by its transverse rupture strength. The drill bit is also subjected to varying degrees of impact and fatigue loading while drilling through earthen formations of varying hardness. It is important that the bit possesses adequate toughness to withstand such impact and fatigue loading. Additionally, during drilling processes, drilling fluids, often laden with rock cuttings, can cause erosion of the bit body. Thus, it is also important that the matrix body material be sufficiently erosion resistant to withstand degradation caused by the surrounding erosive environment. Furthermore, it is also important that the matrix body possesses adequate braze strength to hold the cutters in place while drilling. If a matrix bit body does not provide sufficient braze strength, the cutters may be sheared from the drill bit body and the expensive cutters may be lost. In addition to high transverse rupture strength (TRS), toughness and erosion resistance, a matrix body also should possess adequate steel bond strength (the ability of the matrix to bond with the reinforcing steel piece placed at the core of the drill bit).

In one embodiment, a matrix bit body may be formed from a matrix powder of several types of tungsten carbide that includes (a) stoichiometric tungsten carbide particles; (b) cemented tungsten carbide particles; and (c) cast tungsten carbide particles. The first type of tungsten carbide, stoichiometric tungsten carbide or component (a), may include at least one selected from macrocrystalline tungsten carbide and carburized tungsten carbide. The second type of tungsten carbide, cemented tungsten carbide or component (b), may include at least one selected from sintered spherical tungsten carbide and crushed cemented tungsten carbide. The third type of tungsten carbide, cast tungsten carbide or component (c), may include at least one selected from spherical cast tungsten carbide and crushed cast tungsten carbide. In one preferred embodiment, component (a) may include macrocrystalline tungsten carbide particles. In another preferred embodiment, component (b) may include sintered spherical tungsten carbide particles. In yet another preferred embodiment, component (b) may include crushed cemented tungsten carbide particles.

As discussed above, one type of tungsten carbide is macrocrystalline carbide. This material is essentially stoichiometric WC in the form of single crystals. Most of the macrocrystalline tungsten carbide is in the form of single crystals, but some bicrystals of WC may form in larger particles. The manufacture of macrocrystalline tungsten carbide is disclosed, for example, in U.S. Pat. Nos. 3,379,503 and 4,834,963, which are herein incorporated by reference.

U.S. Pat. No. 6,287,360, which is assigned to the assignee of the present invention and is herein incorporated by reference, discusses the manufacture of carburized tungsten carbide. Carburized tungsten carbide, as known in the art, is a product of the solid-state diffusion of carbon into tungsten metal at high temperatures in a protective atmosphere. Carburized tungsten carbide grains are typically multi-crystalline, i.e., they are composed of WC agglomerates. The agglomerates form grains that are larger than individual WC crystals. These larger grains make it possible for a metal infiltrant or an infiltration binder to infiltrate a powder of such large grains. On the other hand, fine grain powders, e.g., grains less than 5 μm, do not infiltrate satisfactorily.

Typical carburized tungsten carbide contains a minimum of 99.8% by weight of carbon infiltrated WC, with a total carbon content in the range of about 6.08% to about 6.18% by weight. Tungsten carbide grains designated as WC MAS 2000 and 3000-5000, commercially available from H.C. Stark, are carburized tungsten carbides suitable for use in the formation of the matrix bit body disclosed herein. The MAS 2000 and 3000-5000 carbides have an average size of 20 and 30-50 micrometers, respectively, and are coarse grain conglomerates formed as a result of the extreme high temperatures used during the carburization process.

Another form of tungsten carbide is cemented tungsten carbide (also known as sintered tungsten carbide), which is a material formed by mixing particles of tungsten carbide, typically monotungsten carbide, and cobalt particles, and sintering the mixture. Methods of manufacturing cemented tungsten carbide are disclosed, for example, in U.S. Pat. Nos. 5,541,006 and 6,908,688, which are herein incorporated by reference. Sintered tungsten carbide is commercially available in two basic forms: crushed and spherical (or pelletized). Crushed sintered tungsten carbide is produced by crushing sintered components into finer particles, resulting in more irregular and angular shapes, whereas pelletized sintered tungsten carbide is generally rounded or spherical in shape.

Briefly, in a typical process for making cemented tungsten carbide, a tungsten carbide powder having a predetermined size (or within a selected size range) is mixed with a suitable quantity of cobalt, nickel, or other suitable binder. The mixture is typically prepared for sintering by either of two techniques: it may be pressed into solid bodies often referred to as green compacts, or alternatively, the mixture may be formed into granules or pellets such as by pressing through a screen, or tumbling and then screened to obtain more or less uniform pellet size. Such green compacts or pellets are then heated in a controlled atmosphere furnace to a temperature near the melting point of cobalt (or the like) to cause the tungsten carbide particles to be bonded together by the metallic phase. Sintering globules of tungsten carbide specifically yields spherical sintered tungsten carbide. Crushed cemented tungsten carbide may firther be formed from the compact bodies or by crushing sintered pellets or by forming irregular shaped solid bodies.

The particle size and quality of the sintered tungsten carbide can be tailored by varying the initial particle size of tungsten carbide and cobalt, controlling the pellet size, adjusting the sintering time and temperature, and/or repeated crushing larger cemented carbides into smaller pieces until a desired size is obtained. In one embodiment, tungsten carbide particles (unsintered) having an average particle size of between about 0.2 μm to about 20 μm are sintered with cobalt to form either spherical or crushed cemented tungsten carbide. In a preferred embodiment, the cemented tungsten carbide is formed from tungsten carbide particles having an average particle size of about 0.8 μm to about 5 μm. In some embodiments, the amount of cobalt present in the cemented tungsten carbide is such that the cemented carbide is comprised of from about 6 to 8 weight percent cobalt. In other embodiments, the cemented tungsten carbide used in the mixture of tungsten carbides to form a matrix bit body may have a hardness ranging from about 90 to 92 Rockwell A.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. In one embodiment of the present invention, the cast tungsten carbide used in the mixture of tungsten carbides is comprised of from about 3.7 to about 4.2 weight percent carbon.

The various tungsten carbides disclosed herein may be selected so as to provide a bit that is tailored for a particular drilling application. For example, the type, shape, and/or size of carbide particles used in the formation of a matrix bit body may affect the material properties of the formed bit body, including, for example, fracture toughness, transverse rupture strength, and erosion resistance.

In one embodiment, a matrix powder including a combination of tungsten carbide particles may be used to form a matrix bit body having an erosion rate of less than 0.001 in/hr; a toughness of greater than 20 ksi($in^{0.5}$); and a transverse rupture strength of greater than 140 ksi. In various other embodiments, the toughness may be greater than 21 ksi($in^{0.5}$) or 22 ksi($in^{0.5}$). In various other embodiments, the transverse rupture strength of the bit may be less than 250 ksi.

In another embodiment, the matrix powder may contain a mixture of the several of the above described forms of tungsten carbide in various proportions to form a hard particle phase of a matrix body, where the hard particle phase is surrounded by a metallic binder. In one embodiment, the matrix body formed from a matrix powder that is comprised of (a) tungsten carbide in an amount less than or equal to 30 weight percent of the matrix powder; (b) cemented tungsten carbide in an amount less than or equal to 40 weight percent of the matrix powder; and (c) cast tungsten carbide in an amount of less than or equal to 60 weight percent of the matrix powder. In a preferred embodiment, component (a) is present in an amount between about 22 and 28 weight percent of the matrix powder; component (b) is present in an amount between about 22 and 28 weight percent of the matrix powder; and component (c) is present in an amount between 44 and 56 weight percent of the matrix powder.

Carbide particles are often measured in a range of mesh sizes, for example −40+80 mesh. The term "mesh" actually refers to the size of the wire mesh used to screen the carbide particles. For example, "40 mesh" indicates a wire mesh screen with forty holes per linear inch, where the holes are defined by the crisscrossing strands of wire in the mesh. The hole size is determined by the number of meshes per inch and the wire size.

The mesh sizes referred to herein are standard U.S. mesh sizes. For example, a standard 40 mesh screen has holes such that only particles having a dimension less than 420 μm can pass. Particles having a size larger than 420 μm are retained on a 40 mesh screen and particles smaller than 420 μm pass through the screen. Therefore, the range of sizes of the carbide particles is defined by the largest and smallest grade of mesh used to screen the particles. Carbide particles in the range of −16+40 mesh (i.e., particles are smaller than the 16 mesh screen but larger than the 40 mesh screen) will only contain particles larger than 420 μm and smaller than 1190 μlm, whereas particles in the range of −40+80 mesh will only contain particles larger than 180 μm and smaller than 420 μm.

In one embodiment of the present invention, a matrix powder contains (a) stoichiometric tungsten carbide particles having a mesh size of −325+625 mesh; (b) cemented tungsten carbide particles having a mesh size of −170+625 mesh; and (c) cast tungsten carbide particles having a mesh size of −60+325 mesh. In one exemplary embodiment, component (b) has a mesh size of −200+400 mesh.

The matrix body material in accordance with embodiments of the invention has many applications. Generally, the matrix body material may be used to fabricate the body for any earth-boring bit which holds a cutter or a cutting element in place. Earth-boring bits that may be formed from the matrix bodies disclosed herein include PDC drag bits, diamond coring bits, impregnated diamond bits, etc. These earth-boring bits may be used to drill a wellbore by contacting the bits with an earthen formation.

A PDC drag bit body manufactured according to embodiments of the invention is illustrated in FIG. 1. Referring to FIG. 1, a PDC drag bit body is formed with blades 10 at its lower end. A plurality of recesses or pockets 12 are formed in the faces to receive a plurality of conventional polycrystalline diamond compact cutters 14. The PDC cutters, typically cylindrical in shape, are made from a hard material such as tungsten carbide and have a polycrystalline diamond layer covering the cutting face 13. The PDC cutters are brazed into the pockets after the bit body has been made. Methods of making polycrystalline diamond compacts are known in the art and are disclosed in U.S. Pat. Nos. 3,745,623 and 5,676,496, for example. Methods of making matrix bit bodies are known in the art and are disclosed for example in U.S. Pat. No. 6,287,360, which is assigned to the assignee of the present invention. These patents are hereby incorporated by reference.

Figure 2:
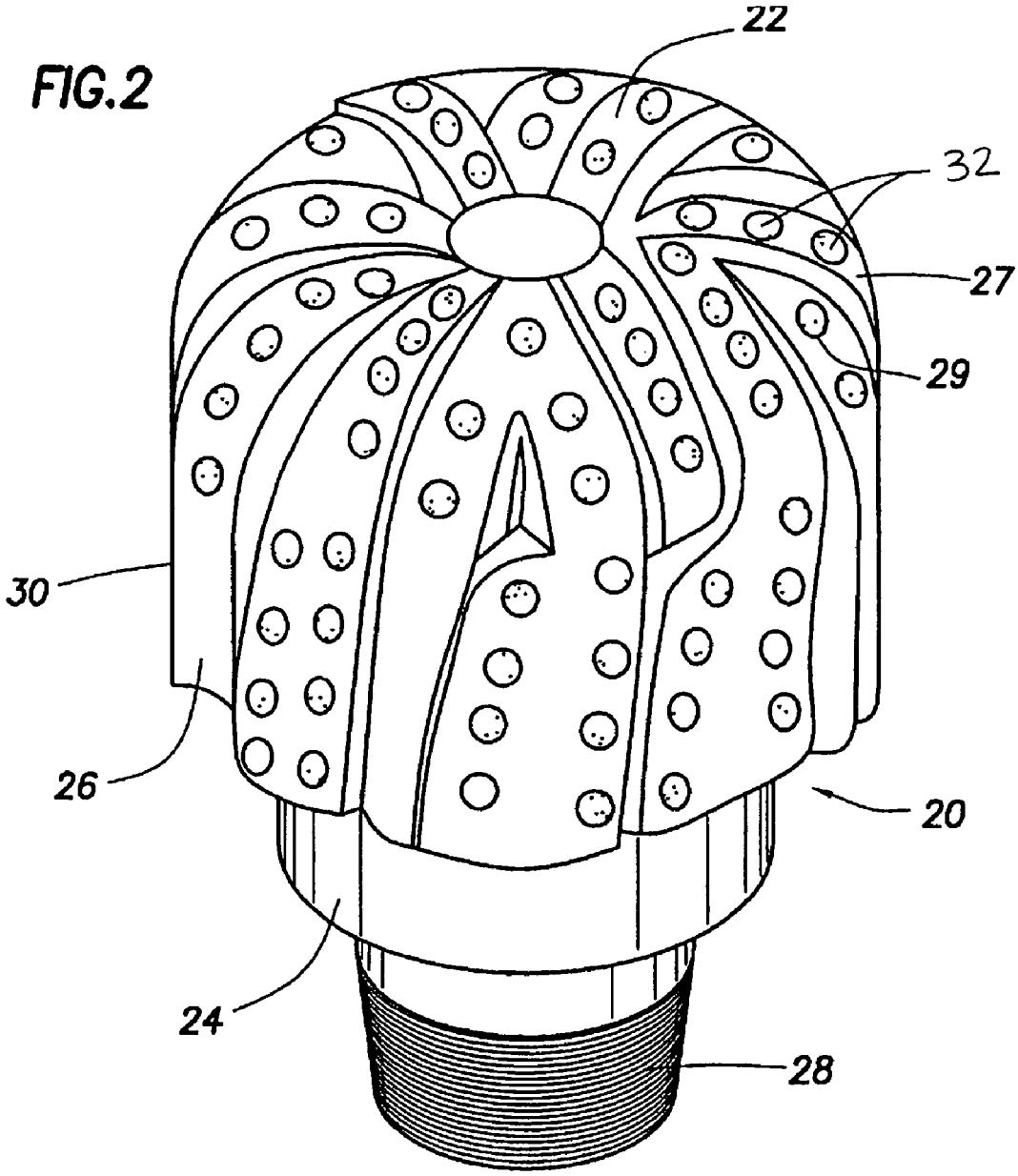
FIG. 2 is a perspective view of a diamond impregnated drill bit according to another embodiment of the present invention.

A diamond impregnated diamond bit manufactured according to embodiments of the invention is illustrated in FIG. 2. Referring now to FIG. 2, a diamond impregnated drill bit 20 includes a shank 24 and a crown 26. Shank 24 may be formed of steel and includes a threaded pin 28 for attachment to a drill string. Crown 26 has a cutting face 22 and outer side surface 30. According to one embodiment, crown 26 comprises a matrix material according to one embodiment of the present invention. Additionally, the mass of tungsten carbides may be impregnated with synthetic or natural diamond particles. In one embodiment, the diamond particles may serve as a cutting element for the drill bit.

Additionally, crown 26 may optionally include various surface features, such as raised ridges 27. Further, formers may be included during manufacturing of the bit body so that the infiltrated, diamond-impregnated crown includes a plurality of holes or sockets 29 that are sized and shaped to receive a corresponding plurality of diamond-impregnated inserts 32. Once crown 26 is formed, inserts 32 may be mounted in the sockets 29 and affixed by any suitable method, such as brazing, adhesive, mechanical means such as interference fit, or the like.

In a bit body, the tungsten carbide particles may be surrounded by a metallic binder. The metallic binder may be formed from a metallic binder powder and an infiltration binder. The metallic binder powder may be pre-blended with the matrix powder hard carbide particles. To manufacture a bit body, matrix powder is infiltrated by an infiltration binder. The term "infiltration binder" herein refers to a metal or an alloy used in an infiltration process to bond the various particles of tungsten carbide forms together. Suitable metals include all transition metals, main group metals and alloys thereof. For example, copper, nickel, iron, and cobalt may be used as the major constituents in the infiltration binder. Other elements, such as aluminum, manganese, chromium, zinc, tin, silicon, silver, boron, and lead, may also be present in the infiltration binder. In one preferred embodiment, the infiltration binder is selected from at least one of nickel, copper, and alloys thereof. In another preferred embodiment, the infiltration binder includes a Cu—Mn—Ni—Zn alloy.

In one embodiment, the matrix powder comprises the mixture of tungsten carbides and a metallic binder powder. In a preferred embodiment, nickel and/or iron powder may be present as the balance of the matrix powder, typically from about 2% to 12% by weight. In addition to nickel and/or iron, other Group VIIIB metals such as cobalt and various alloys may also be used. For example, it is expressly within the scope of the present invention that Co and/or Ni is present as the balance of the mixture in a range of about 2% to 15% by weight. Metal addition in the range of about 1% to about 12% may yield higher matrix strength and toughness, as well as higher braze strength. In another preferred embodiment, the matrix powder comprises nickel in an amount ranging from about 2 to 4 weight percent of the matrix powder and iron in an amount ranging from about 0.5 to 1.5 weight percent of the matrix powder.

The mixture includes preferably at least 80% by weight carbide of the total matrix powder. While reference is made to tungsten carbide, other carbides of Group 4a, 5a, or 6a metals may be used. Although the total carbide may be used in an amount less than 80% by weight of the matrix powder, such matrix bodies may not possess the desired physical properties to yield optimal performance.

EXAMPLES

Figure 3:
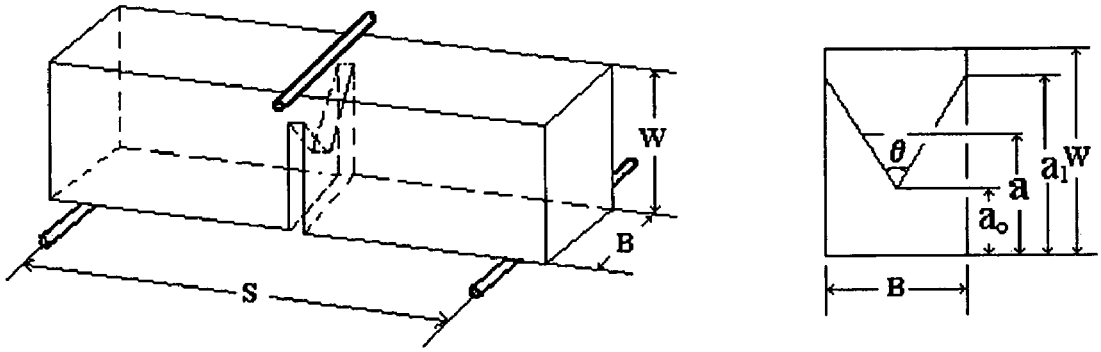
FIG. 3 shows a chevron-notched bar for determining fracture toughness.

Matrix powders having various components were infiltrated to test for various material properties, including transverse rupture strength (TRS), toughness, wear, and erosion resistance. Fracture toughness was measured as $K_{Ivb}$ (generally indicated as $K_{IC}$) in accordance with the ASTM C1421 chevron-notched beam test method. For this test, $$K_{Ic} = \frac{P\max}{B\sqrt{W}} Y_C(\alpha_0, \alpha_1)$$

wherein $P_{max}$ is the maximum load, B is the thickness of the specimen, W is the height, and $Y_c$ is a coefficient based on geometric factors, defined as the minimum stress-intensity factor coefficient. When the crack length $\alpha$ increases to a critical value $\alpha_c$, $Y(\alpha_0, \alpha_1, \alpha)$ reaches a minimum $Y_c(\alpha_0, \alpha_1)=Y(\alpha_0, \alpha_1, \alpha_c)$, and at the same time, the load P reaches a maximum $P_{max}$. FIG. 3 shows the geometry of a standard chevron-notched test specimen and the parameters used to calculate $Y_c$. Table 1 shows the $Y_c$ value for geometry parameters S=32, W=8, B=4, and $\theta$=55°, for Poison ratios of 0.25 and 0.3 that may be used to calculate $K_{IC}$.

TABLE 1

| $\alpha_0$ | $Y_C$ with Poison ratio 0.25 | $Y_C$ with Poison ratio 0.3 |
|---|---|---|
| 0.3 | 14.5145 | 14.51084 |
| 0.31 | 15.04254 | 15.03891 |
| 0.32 | 15.59683 | 15.59324 |
| 0.33 | 16.17944 | 16.17588 |
| 0.34 | 16.79259 | 16.78908 |
| 0.35 | 17.43874 | 17.43527 |
| 0.36 | 18.12053 | 18.11711 |
| 0.37 | 18.84087 | 18.8375 |
| 0.38 | 19.60293 | 19.59961 |
| 0.39 | 20.41016 | 20.4069 |
| 0.4 | 21.26637 | 21.26317 |

Wear was measured in accordance with the ASTM B-611 method. Transverse rupture strength (TRS) was measured by a three point bending test, in which cylindrical rods of the matrix body material were formed without surface grinding. To determine the transverse rupture strength, a cylindrical rod 3 inches long with a 0.5 inch diameter was placed on supports with a span of 2.5 inches. A vertical load at a displacement rate of 0.0017 in/sec was applied until failure of the rod. The transverse rupture strength may be calculated based upon the actual load to failure, diameter of the specimen, and loading span.

Tests for erosion resistance were conducted using a full-size in-house mud pump to simulate and evaluate mud erosion of a bit material or hardfacing at BHA condition. A pool of drilling mud was stored in mud tanks and compressed by a mud pump that is driven by a diesel motor. The mud is injected into twin nozzles (standard 16/32") at a velocity of about 107 m/s in each nozzle. A test sample and a reference sample are clamped onto a base plate such that the surface of each sample is perpendicular to the nozzles and spaced at about 2.54 cm apart. The mud used is a 10 lb water-based mud with 2% sand content (F-110 available from U.S. Silica Company, Berkeley Springs, W.Va.). Both samples are subjected to mud erosion for a constant duration of time (usually 30 minutes or 60 minutes) and the resultant wear scar is measured. The size of the wear scar is indicative of the susceptibility of the test sample to erosive wear. The wear resistance of the test sample is normalized against the wear resistance of the reference sample.

In order to improve selected mechanical properties of a matrix bit body, various mixtures of tungsten carbide particles were used to form a matrix body, and their mechanical properties were tested. The compositions include various ratios of cemented tungsten carbide (pellets unless otherwise noted), agglomerated or carburized tungsten carbide, cast tungsten carbide, and macrocrystalline tungsten carbide with a nickel and/or iron binder. The compositions tested are shown below in Table 2.

TABLE 2

| Sample | Composition | | | | | |
|---|---|---|---|---|---|---|
| | WC—Co (%) | Agg. WC (%) | Cast (%) | Macro (%) | Ni (%) | Fe (%) |
| 1 (Prior Art) | — | — | 33 | 65 | — | 2 |
| 2 (Prior Art) | — | 62 | 30 | — | 8 | — |
| 3 (Prior Art) | 90 (crushed) | — | — | — | 10 | — |
| 4 | 24 | — | 48 (−60 + 325) | 24 (−325 + 625) | 2 | 2 |
| 5 | 24 | — | 48 (−60 + 325) | 24 (−325 + 625) | 3 | 1 |
| 6 | 24 | — | 48 | 24 | 3 | 1 |
| 7 | 24 (crushed) | — | 48 | 24 | 3 | 1 |

Some of the compositions shown in Table 2 were measured in accordance with ASTM E-112 to determine their particle size distributions. A particle size distribution analysis was performed on two samples, Samples 6 and 7. The composite particle size distributions of Samples 6 and 7, as well as a breakdown of each component within each, are shown in Table 3.

TABLE 3

| MESH | Sample 6 | Sample 6 Components | | |
|---|---|---|---|---|
| | | 48% Cast −60 + 325 (%) | 24% MCWC or Agg. −325 + 625 (%) | 24% Sintered Pellets −200 + 625 (%) |
| +80 | 1.7 | 3.3 | 0 | 0 |
| −80 + 120 | 10 | 18.3 | 0 | Tr |
| −120 + 170 | 12.4 | 26.3 | 0 | 0.7 |
| −170 + 230 | 18.6 | 26.3 | 0 | 20 |
| −230 + 325 | 18.1 | 23.7 | 2.6 | 29.4 |
| −325 | 39.2 | 1.5 | 97.4 | 24.9 |

| MESH | Sample 7 | Sample 7 Components | | |
|---|---|---|---|---|
| | | 48% Cast −60 + 325 (%) | 24% MCWC or Agg. −325 + 625 (%) | 24% Crushed Cemented WC −200 + 625 (%) |
| +80 | 1.8 | 3.3 | 0 | 0 |
| −80 + 120 | 12.7 | 18.3 | 0 | 0 |
| −120 + 170 | 11.6 | 26.3 | 0 | Tr |
| −170 + 230 | 24.7 | 26.3 | 0 | 38.9 |
| −230 + 325 | 21.1 | 23.7 | 2.6 | 51.9 |
| −325 | 28.1 | 1.5 | 97.4 | 9.2 |

The compositions shown in Table 2 were tested for fracture toughness, wear number transverse rupture strength, and erosion resistance in accordance with the tests detailed above, as shown in Table 4.

TABLE 4

| Sample | Mechanical Properties | | | |
|---|---|---|---|---|
| | Erosion (in/hr) | B611 (krevs/cm$^3$) | TRS (ksi) | $K_{Ic}$ (ksi * in$^{0.5}$) |
| 1 | 0.0010 | 0.70 | 110 | 21.1 |
| 2 | 0.0015 | 0.90 | 140 | 23.3 |
| 3 | 0.0028 | — | 181 | — |
| 4 | 0.0009 | 1.22 | 150 | 22.5 |
| 5 | 0.0009 | 1.06 | 138 | 22.0 |
| 6 | 0.0007 | 1.19 | 154 | 22.1 |
| 7 | 0.0007 | 1.08 | 152 | 23.8 |

Figure 4:
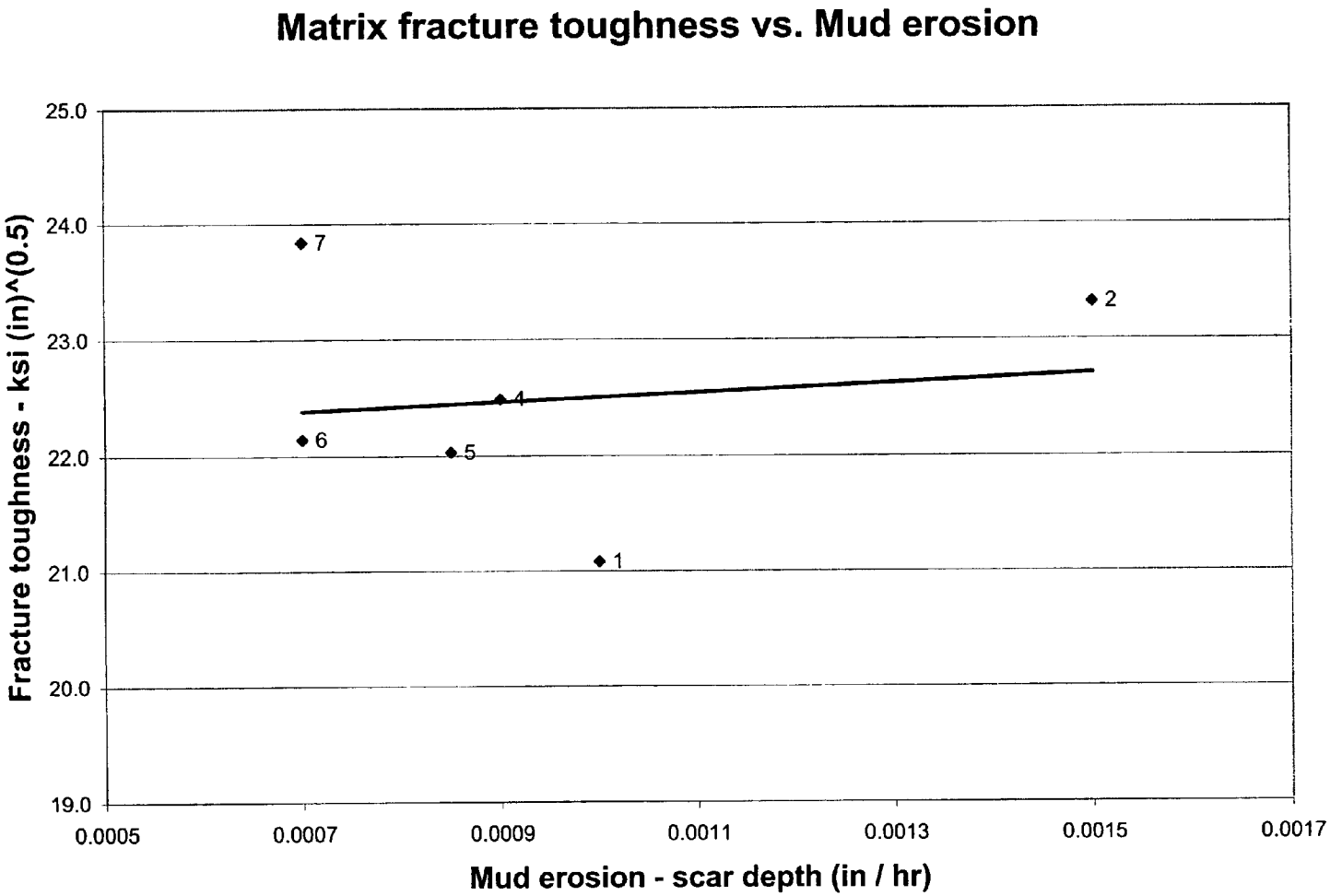
FIG. 4 shows a graphical comparison of fracture toughness versus erosion rates for various matrix materials.

FIG. 4 shows the relationship between fracture toughness and erosion rate for the varios compositions. It is observed that Sample 1 shows good erosion resistance, but lacks strength; Sample 2 has better strength and toughness than Sample 1, but lacks erosion resistance; Sample 3 has good strength, but lacks erosion resistance. In typical pror matrix bits, either erosion resistance or strength/toughness is often increased at the expanse of the other. In Samples 2, for example, erosion resistance is forfeited at the expense of toughness/strength, and vice versa, in Sample 1, strength is forfeited at the expense of erosion resistance. Compared to Samples 1-3, Samples 4-7 exhibit both enhanced erosion resistance and toughness/strength.

While reference to a particular type of bit may have been made, no limitation on the present invention was intended by such description. Rather, the matrix bodies disclosed herein may specifically find use in PDC drag bits, diamond coring bits, impregnated diamond bits, etc. Further, any reference to any particular type of cutting element is also not intended to be a limitation on the present invention.

Advantages of the present invention may include one or more of the following.

The particular combination of stoichiometric tungsten carbide particles, cast tungsten carbide particles, and cemented tungsten carbide particles may allow for a matrix body that exhibits both good erosion resistance and toughness and strength. In particular, as cast carbide content is increased, a matrix material will display greater erosion resistance and lower toughness; as cemented carbide content is increased, a matrix material will display greater toughness and strength, and lower erosion resistance; and as the particle size distribution of hard particles is altered, erosion and/or wear resistance and toughness may vary, for example, finer hard particles may result in higher erosion and wear resistance, while coarser particles may result in higher toughness.

By incorporating a particular combination of these particles, and thus features, in a single matrix material, the resulting matrix body may be advantageously characterized as possessing good erosion resistance, strength, and toughness, and thus not susceptible to cracking and erosion. These advantages may lead to improved bit bodies for PDC drill bits and other earth-boring devices in terms of longer bit life. In particular, embodiments may provide advantages over some prior art matrix bodies predominantly comprised of cemented tungsten carbide particles that display high strength and toughness, but lack erosion resistance. Other advantages may be provided over other prior art matrix bodies that include larger amounts of hard particles, such as cast tungsten carbide and stoichiometric tungsten carbide, thus resulting in bit bodies that display good erosion resistance but lack strength and toughness. Increased erosion and/or abrasion resistance may also be advantageously achieved over other prior art as a result of the optimized particle size distribution of various tungsten carbide components without sacrificing strength and toughness. Thus, the unique combination of the various hard, tough, fine, and coarse carbide particles may provide a more erosion and crack resistant bit body for longer bit life.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drill bit, comprising:

a bit body formed from a matrix powder, wherein the matrix powder comprised:

(a) stoichiometric tungsten carbide particles having a mesh size between 325 mesh and 625 mesh and present in an amount less than or equal to 30 weight percent of the matrix powder;

(b) cemented tungsten carbide particles having a mesh size between 170 mesh and 625 mesh and present in an amount less than or equal to 40 weight percent of the matrix powder; and (c) cast tungsten carbide particles having a mesh size between 60 mesh and 325 mesh and present in an amount less than or equal to 60 weight percent of the matrix powder;

at least one cutting element for engaging a formation, wherein after formation with the matrix powder, the bit body has:

an erosion rate of less than 0.001 in/hr;

a toughness of greater than 20 ksi($in^{0.5}$); and a transverse rupture strength of greater than 140 ksi.

2. The bit of claim 1, wherein component (a) comprises macrocrystalline tungsten carbide.

3. The bit of claim 1, wherein component (b) comprises crushed cemented tungsten carbide.

4. The bit of claim 1, wherein the component (b) has a mesh size between 200 mesh and 400 mesh.

5. The bit of claim 1, wherein the bit has a toughness of greater than 21 ksi($in^{0.5}$).

6. The bit of claim 1, wherein the bit has a transverse rupture strength of less than 250 ksi.

7. The bit of claim 1, wherein the bit body comprises an infiltration binder selected from at least one of copper, nickel, and alloys thereof.

8. A matrix body, comprising:

a hard particle phase formed from a matrix powder, wherein the matrix powder comprised:

(a) stoichiometrie tungsten carbide particles having a mesh size between 325 mesh and 625 mesh and present in an amount less than or equal to 30 weight percent;

(b) cemented tungsten carbide particles having a mesh size between 170 mesh and 625 mesh and present in an amount less than or equal to 40 weight percent; and (c) cast tungsten carbide particles having a mesh size between 60 mesh and 325 mesh and present in an amount less than or equal to 60 weight percent; and an infiltration binder.

9. The matrix body of claim 8, wherein the infiltration binder comprises at least one selected from nickel, copper, and alloys thereof.

10. The matrix body of claim 9, wherein the matrix powder comprised nickel in an amount ranging from about 2 to 4 weight percent of the matrix powder and iron in an amount ranging from about 0.5 to 1.5 weight percent of the matrix powder.

11. The matrix body of claim 8, wherein the matrix powder further comprised at least one selected from nickel, cobalt, iron, and alloys thereof.

12. The matrix body of claim 8, wherein component (a) comprises macrocrystalline tungsten carbide.

13. The matrix body of claim 8, wherein component (b) comprises crushed cemented tungsten carbide.

14. The matrix body of claim 8, wherein component (b) has a mesh size between 200 mesh and 400 mesh.

15. The matrix body of claim 11, wherein component (a) is present in an amount between about 22 and 28 weight percent of the matrix powder; component (b) is present in an amount between about 22 and 28 weight percent of the matrix powder; and component (c) is present in an amount between 44 and 56 weight percent of the matrix powder.

16. The matrix body of claim 8, wherein component (b) comprises from about 6 to 8 percent cobalt, and wherein component (b) has a hardness ranging from about 90 to 92 Rockwell A.

17. The matrix body of claim 8, wherein component (c) comprises from about 3.8 to about 4.2 weight percent carbon.

* * * * *